US005501338A

United States Patent [19]

Preston

[11] Patent Number: 5,501,338

[45] Date of Patent: Mar. 26, 1996

[54] FOOD CARRIER SYSTEM

[76] Inventor: Paul E. Preston, 4359 Ward Dr. NE., Salem, Oreg. 97305

[21] Appl. No.: 198,877

[22] Filed: Feb. 18, 1994

[51] Int. Cl.[6] ..... A45C 11/20; B65D 21/02; A45F 5/00

[52] U.S. Cl. ..... 206/545; 206/499; 206/548; 206/549; 220/4.27; 220/533; 294/31.2; 294/149; 294/150; 294/161

[58] Field of Search ..... 294/31.2, 150, 294/149, 156, 161; 206/545, 548, 549, 499; 62/457.1; 220/4.26, 4.27, 532, 533

[56] References Cited

U.S. PATENT DOCUMENTS

| | | | |
|---|---|---|---|
| Re. 29,415 | 9/1977 | Ricobene et al. . | |
| D. 241,600 | 9/1976 | Ashton . | |
| 1,542,115 | 6/1925 | Weis . | |
| 1,607,024 | 11/1926 | Thomson | 206/499 X |
| 1,736,961 | 11/1929 | Von Alvensleben | 294/31.2 X |
| 2,623,656 | 12/1952 | Rottau | 206/499 X |
| 2,724,494 | 11/1955 | Graff | 206/545 |
| 2,807,387 | 9/1957 | Siciliano . | |
| 3,117,692 | 1/1964 | Carpenter et al. | 220/532 X |
| 3,144,016 | 8/1964 | Basci . | |
| 3,811,559 | 5/1974 | Carter . | |
| 3,851,754 | 12/1974 | Jones . | |
| 4,082,208 | 4/1978 | Lane, Jr. | 220/4.27 X |
| 4,346,813 | 8/1982 | Cho et al. | 220/532 |
| 4,545,487 | 10/1985 | Asmus | 206/545 X |
| 4,598,746 | 7/1986 | Rabinowitz | 206/545 X |
| 4,969,558 | 11/1990 | Fisher . | |
| 5,004,882 | 4/1991 | Nottingham et al. . | |
| 5,169,199 | 12/1992 | De Ruyter et al. | 294/149 |

*Primary Examiner*—Bryon P. Gehman

[57] ABSTRACT

The food carrier comprises a plurality of stacked, interchangeable rigid food tray assemblies, at least one of the tray assemblies having a plurality of compartments formed therein. A strap secures the stacked food tray assemblies to each other, the strap comprises a handle for carrying the food carrier. A thermally insulative cover is provided for the outside of the food tray assemblies for stabilizing the temperature of any food contained therein.

2 Claims, 2 Drawing Sheets

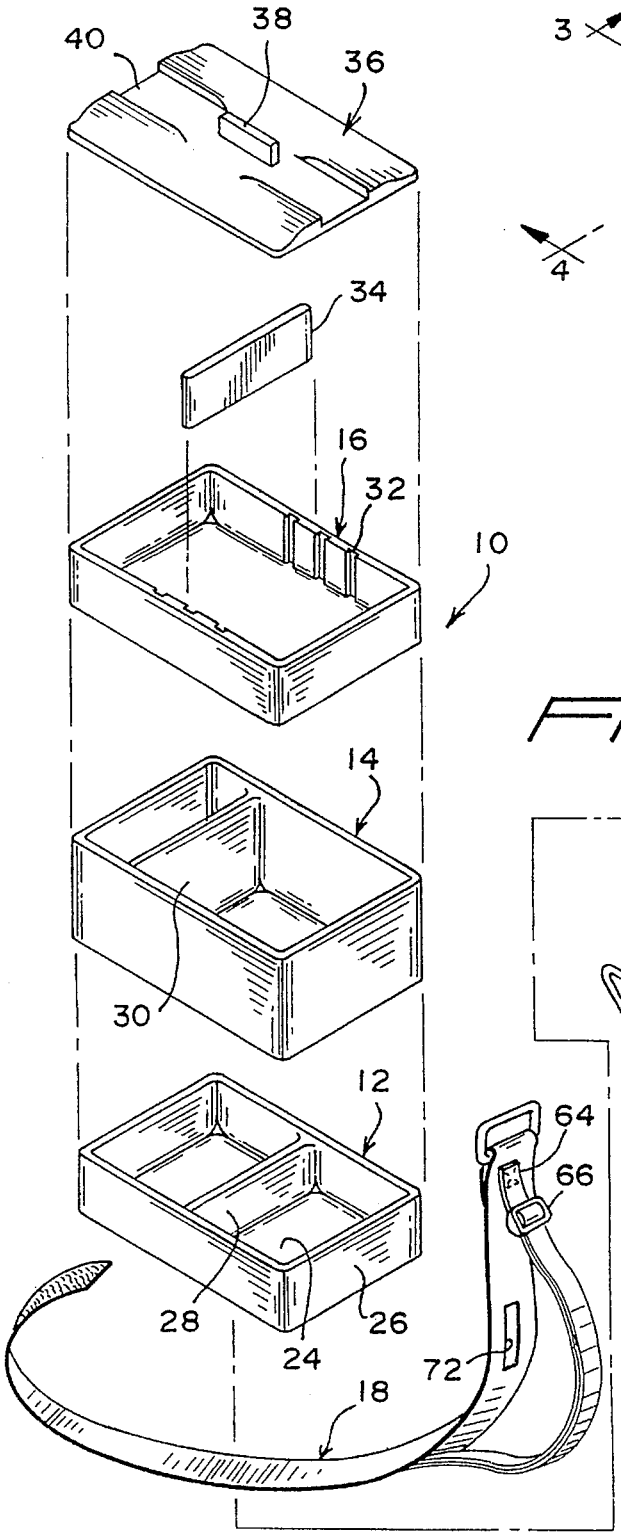
FIG. 1
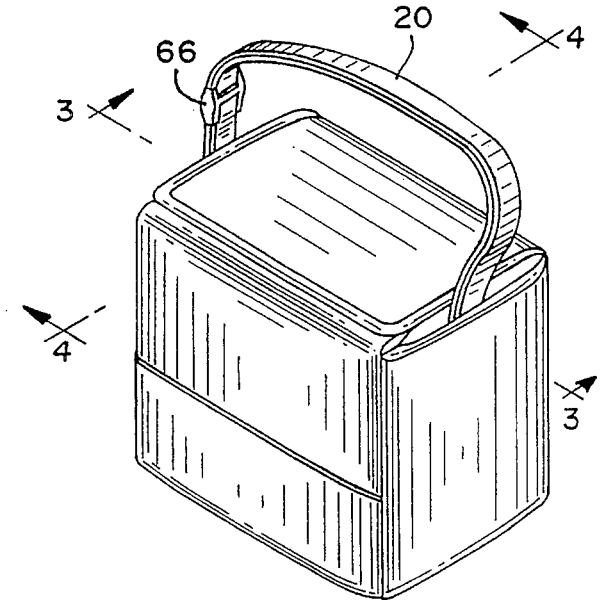
FIG. 2
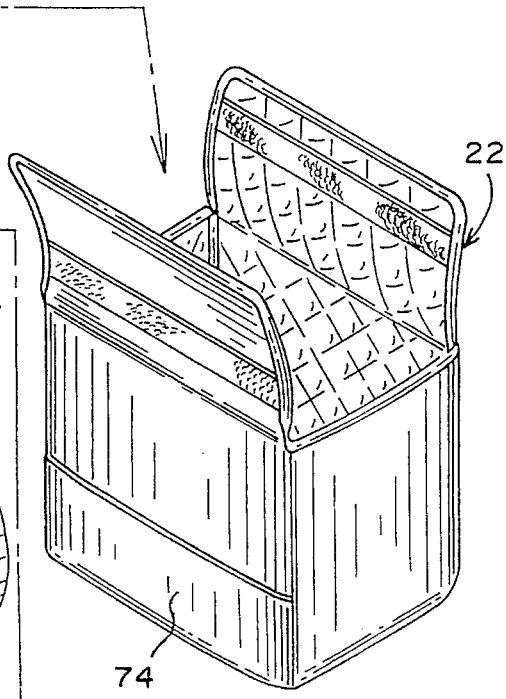

FOOD CARRIER SYSTEM

BACKGROUND OF THE INVENTION

1. Field of the Invention

The present invention relates to food carrying devices and more particularly to a food carrier system having stacked, food trays which are strapped together and insulated.

2. Description of the Related Art

Numerous manufacturers have provided food carriers (commonly known as "lunch boxes"), designed and marketed specifically for children, and for the manual laborer, or so-called "blue collar" worker. In addition, many other kinds of people also carry food to their places of work, or elsewhere, using a plain paper bag. However, there is not presently a food carrier available, designed particularly for the needs of "white collar," or office workers. These individuals, as a consequence, have had little other option than to use paper bags to carry food to work.

The disadvantage of paper bags is that they require most foods to be wrapped first in some other material: wax paper, aluminum foil, plastic wrap, etc., or to be placed first in other containers prior to being placed in the paper bag. All of this paper, aluminum foil, plastic wrap, and other wrapping materials, are ultimately discarded. This paper-intensive system uses up enormous amounts of material, wood pulp, petroleum, and other products, and it also increases the total amount of garbage produced. Using paper bags to carry food, therefore, is uneconomical, wasteful, and environmentally harmful. In addition perishable food is poorly insulated when carried in a paper bag. On a commute from home to work, for example, various temperature sensitive foods—i.e., mayonnaise—may become warmed, increasing their pathogenic bacterial content, and consequently present a potential health hazard to the consumer. And, as a practical matter, it is awkward to transport certain types of foods in a paper bag, particularly those foods that are high in nutrition. Soup, fruit and vegetables, salads, stew and other cooked foods are difficult to transport—even with the use of supplementary containers—in a paper bag.

A patent search has revealed the following references:

U.S. Pat. No. 241,600 discloses a combined storage container and carrying handle having two stacked food storage containers.

U.S. Pat. No. 29,415 discloses a food container assembly having a channeled interior bottom surface and vent means leading outwardly of the tray members, with the tray members including a bottom, a top, which is nestably associated with the bottom, for containing a single food item; and a plurality of intermediate tray members which may be stacked in vertical tandem for containing a plurality of food pieces in a unitary stacked carton arrangement.

U.S. Pat. No. 1,542,115 discloses food storing dishes including an elongated dish, of a multiple number of smaller dishes upon which the larger dish is superimposed, the larger dish being provided with depending transverse and longitudinal flanges upon its bottom wall, and with a marginal shoulder, the shoulder being engageable with the upper edges of the smaller dishes, the longitudinal flanges being cut away to permit the bottom of the larger dish to overlap the adjacent upper edges of the smaller dishes.

U.S. Pat. No. 2,807,387 discloses complementary, stackable containers having interlocking receptacles generally similar with one receptacle adapted removable to be fastened over another to serve as a lid or cover for it.

U.S. Pat. No. 3,811,559 discloses a stackable series of individually insulative containers.

U.S. Pat. No. 5,004,882 discloses a cooking utensil comprising a metal baking pan with a girdle fitted around the outside edge of the pan to space the pan from the oven walls. The girdle may be provided with an interior shoulder to accept a lip on the pan. A rib on the girdle extending above the shoulder may be used to capture the pan lip between the rib and the shoulder in a snap-fit arrangement.

U.S. Pat. No. 4,969,558 discloses a lunchbox apparatus wherein a removable lid frictionally engages an upper end of the lunchbox container. The lid may include compartments therewithin for securement of different food components and additionally may include spaced walls defining a single chamber therebetween. The apparatus is arranged to be used with a microwave.

U.S. Pat. No. 3,851,754 discloses a plurality of stackable, interfitting trays each formed with recessed compartments. A cover is placed on and interfits with the topmost tray and has attached to it a handle and quick-release tie means to retain the pack of trays and cover assembled. The tie means may comprise resilient binding cords with claw clips at the two ends thereof for engagement in locating recesses in the lowest tray of the pack.

U.S. Pat. No. 3,144,016 discloses compression-coupled stacked vessels. The bottom vessel includes a pair of diametrically opposed individual fixed bail-type handles protruding from the side walls thereof.

None of the aforementioned inventions include the combined capabilities of stacking food trays, securely strapping them together for transportation, and thermally insulating the trays, as a bulk, by an insulative cover.

SUMMARY OF THE INVENTION

The food carrier of the present invention comprises a plurality of stacked, interchangeable rigid food tray assemblies, at least one of the tray assemblies having a plurality of compartments formed therein. A strap secures the stacked food tray assemblies to each other, the strap comprises a handle for carrying the food carrier. A thermally insulative cover is provided for the outside of the food tray assemblies for stabilizing the temperature of any food contained therein.

In a more narrow aspect, the strap comprises a main strap, including: a first end portion; a second, opposite, end portion comprising a terminal end including a strip of VELCRO strip and an intermediate part having a complementary strip of VELCRO strip; and, a loop secured to the first end portion, the main strap being sufficiently long to extend around the food tray assemblies when they are in a stacked orientation, so that the terminal end may be introduced through the loop and against the complementary strip of VELCRO so as to secure the tray assemblies.

In another more narrow aspect the strap comprises a secondary strap, comprising: a first end attached to the first end portion of the main strap, and a second end attached at another portion of the main strap so that the second strap may be extended through openings formed in flaps of the insulative cover so as to serve as a handle.

The invention is "paperless." This advantage allows the user to place food items directly into the trays without first having to wrap them in wax paper, aluminum foil, etc., or having to place them into plastic holders or other containers. One or more trays is preferably designed with an adjustable divider to accommodate variably sized food items, such as sandwiches of varying sizes. This feature holds the food items securely, without the necessity of being wrapped in paper. Each of the trays is designed to accommodate another tray, at its uppermost dimension, fitting securely as its lid. The top tray is likewise designed; however, it may utilize a flat or dome-shaped lid with a projection at its top, and a longitudinal groove or recess to receive the wider (main) strap. The tray assemblies, when secured by either a woven polypropylene strap fabric, or other closure device, creates compartments in the trays which are water tight and appropriate for conveniently transporting foods.

The protective and insulative cover envelopes all six sides of the nest of trays and allows the food in them to be transported while minimizing temperature change. If the food has first been refrigerated, it can be transported in the trays with the insulative cover in place; the heat gain by the food in the trays is greatly reduced because of the insulative properties of the cover. Likewise, if the food in the trays is hot, the insulative cover will reduce thermal loss until such time as the cover is removed and the trays are taken apart for consuming the food.

Other objects, advantages, and novel features will become apparent from the following detailed description of the invention when considered in conjunction with the accompanying drawings.

BRIEF DESCRIPTION OF THE DRAWINGS

FIG. 1 is an exploded perspective view of the preferred embodiment of the present invention in which the cover is shown open to receive the food trays.

FIG. 2 is a perspective view of the present invention with the cover closed and the handle protruding through openings formed in flaps of the cover.

The same elements throughout the figures are designated by the same reference characters.

DETAILED DESCRIPTION OF THE PREFERRED EMBODIMENTS

Figure 3:
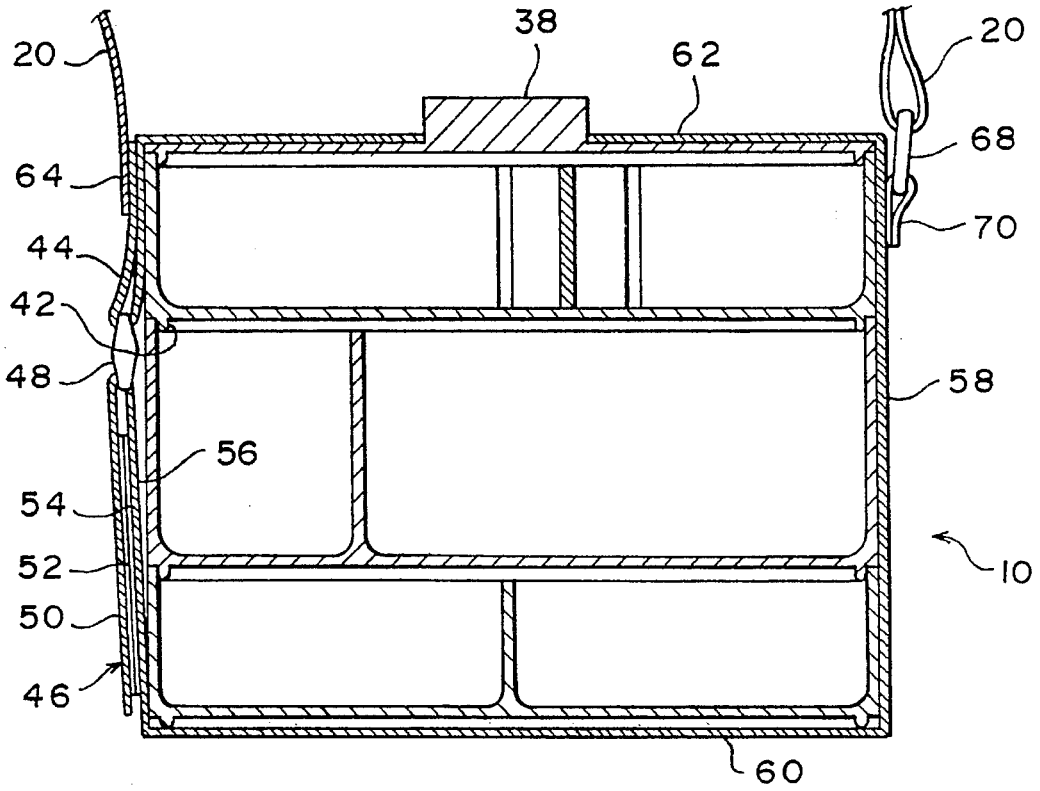
FIG. 3 is a cross-sectional view of the present invention taken along line 3—3 of FIG. 2.

Referring to the drawings and the characters of reference marked thereon, FIG. 1 illustrates a preferred embodiment of the food carrier of the present invention, designated generally as 10. Food carrier 10 includes a plurality of stackable, interchangeable rigid food tray assemblies 12,14, 16. A strap means, designated generally as 18 includes a main strap 19 which secures the stacked food tray assemblies 12,14,16 to each other (as will be described below). The strap means 18 includes a secondary strap or handle 20 for carrying the food carrier 10. A thermally insulative cover 22 fits around the outside of the stacked food tray assemblies 12,14,16 for stabilizing the temperature of any food contained therein.

The tray assemblies 12,14,16 are generally rectangular in cross-section and each includes a substantially flat horizontal base 24 and vertical sidewalls 26. Tray assembly 12 includes an integral tray divider 28. This forms two equal compartments for holding a wide variety of food items such as soup, stew, lasagna, corn bread, spaghetti, or other typical lunch items, as well as desserts.

Tray assembly 14 is relatively deep and is designed—in part— to hold a can of soda. It also includes an integral tray divider 30 which allows its other compartment to hold a mixed salad, apples, oranges, muffins, or other food items that are relatively bulky.

Tray assembly 16 includes a plurality of spaced vertical slots 32. Ends of a tray divider wall 34 are positionable within the slots so as to provide varying compartment sizes. This allows the user to regulate the compartment size to hold food snugly—such as sandwiches—which are of variable sizes. This same tray can also be used without the divider for containing items such as bananas, pizza, or enchiladas, and other foods which require more horizontal space. If this tray is not required to hold food, it may be used to carry cutlery, napkins, tea bags, packets of sweetener, and similar items.

A tray assembly lid 36 fits over the uppermost tray assembly 16. Lid 36 includes a central projection 38 for handling and for engaging the strap 18, as will be described below. A longitudinal recess 40 provides guidance for the strap 18.

Each tray assembly is preferably formed of acrylonitrile butadiene styrene, a plastic, commonly known as "ABS", although other rigid materials, preferably rigid plastics may also be used. The inside angles, formed by the horizontal and vertical portions of the tray, are preferably rounded to make cleaning the trays easier. The outside corners are also preferably rounded to help prevent chipping, reduce wear to the cover, and as an aesthetic consideration.

It is noted that the above-described arrangement of tray dividers, i.e. including the removable and integral characteristics, has been described for the purposes of illustration and not limitation. A great variety of other arrangements of tray assemblies may be utilized. For example, a fourth tray assembly may be used with no divider. This would lend itself to holding relatively flat items, such as cookies, pretzels, nuts, crackers, or other snack items. If this tray is not required to be used to hold food, it could be used to hold a container of frozen artificial ice, thus greatly extending the time which the food in the other trays will remain cold.

If the user desires, less than the normal three trays may be used. One, two, or three trays may be used, along with the appropriate sized strap 18. The trays and the lid are preferably microwavable, and they may be cleaned in an automatic dishwasher, all of which makes them suitable and convenient for their intended use.

Figure 4:
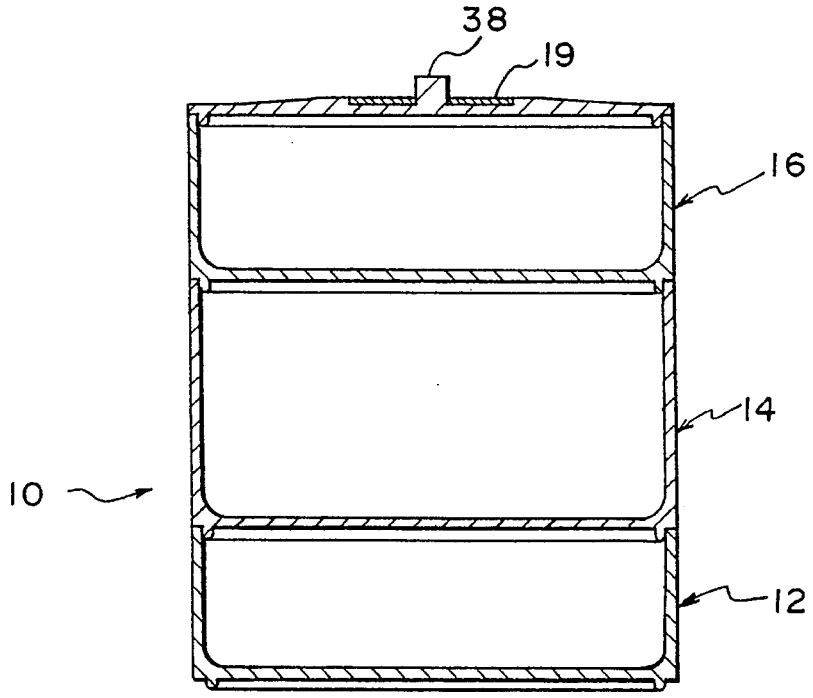
FIG. 4 is a cross-sectional view of the present invention taken along line 4—4 of FIG. 2.

FIGS. 3 and 4 illustrate the manner in which the tray assemblies 12,14,16 are stacked in vertical tandem. Each tray includes a downwardly extending rim 42, extending from each base 24. These rims 42 engage the upper ends of the sidewalls 26 to maintain the desired alignment.

Strap means 18 is preferably formed of woven polypropylene material, also known as "webbing," nylon or similar material. Strap means 18 includes a first end portion 44 and a second end portion, designated generally as 46. First end 44 is securely wrapped around a rigid loop 48. Second end portion 46 includes a terminal end 50 which includes a strip of fabric 52 of the type that has either tiny loops or has hooks that fasten to a complementary strip of fabric having either hooks or loops, so that the strips can be fastened or unfastened simply by pressing them together or pulling them apart. This material is commonly sold under the trademark, "VELCRO". In use, to secure the tray assemblies, the terminal end 50 is wrapped around rigid loop 48. A complementary strip 54 of Velcro is located on an intermediate part 56 of second end portion 46. Thus, when wrapped around the tray assemblies, the strap 19 forms two vertical portions 44,46 on one side of the food carrier 10, a vertical portion 58 on the other side, and two horizontal portions 60,62, on the bottom and top, respectively.

One end 64 of the relatively narrow second strap 20 is attached to vertical portion 44. The strap 20 is looped through a "double slide" 66, then through a "single slide" 68 which is attached (preferably sewn) by element 70 to vertical portion 58 of the main strap 19. Finally, the strap 20 is looped back through double slide 66 to provide a snug but adjustable lengthening or shortening of the strap handle when the double slide 66 is adjusted from side to side.

To stabilize the wide strap 19, a rectangular cut-out 72 is provided at the center of the wide strap 19 at the top of the lid 36. This cut-out, or slot, allows the like-sized protrusion or handle 38 of the lid, to pass through it. This arrangement restrains the strap 19 from moving horizontally.

On both top ends of the lid 36, a longitudinal recess or groove 40 is formed through which the strap 18 is secured. These grooves 40 restrict the strap 18 from moving horizontally, particularly at right angles to the direction of the slot at top of the lid, thereby creating a stable means of carrying the nest of trays.

A unique and important aspect of this invention concerns the above-mentioned positions where the ends of the narrow strap handle 20 are sewn: If the ends of the narrow strap handle 20 were sewn on the horizontal portions of the wider strap 19, it would tend to pull the wider strap 19 up and displace the rectangular slot 72 of the wider strap 19 from the associated lid handle 38. Therefore, it is an essential part of this design that the ends of the strap handle 20 are attached to the vertical portions of either side of the strap 19. When attached in this manner, stress is in the vertical direction, and will not displace the rectangular slot in the strap 19 from the corresponding lid handle.

The nested assemblies 12,14,16 may be conveniently fitted within insulative cover 22. Insulative cover 22 has four distinctive functions: 1) it functions as an insulator, keeping the food cool, or hot, as required, 2) it functions as a tote, or carrier, 3) it functions to protect the trays from scratches and abrasions, and, 4) it provides decoration and a better appearance. The cover 22 consists of four layers: The inside layer, facing the trays, consists of a silicon impregnated fabric which reflects heat and cold. The next layer is a 20 oz. cotton batting, which functions as an insulator. However, other batting, wadding, or filling materials could be used such as polyester, polyvinylchloride (PVC), or polyurethane foam sheeting. The next layer is a non-woven polyester interfacing fabric which functions to hold the insulation in place. The outermost layer, facing the user, consists of a high grade vinyl, for appearance and protection.

The cover functions as a tote, or carrying device, as a result of the pocket 74 which is sewn onto either one, or both sides of the cover. The user can conveniently store tea bags, packets of condiments, napkins, medicine, utensils, and other incidental items here.

The cover 22 protects the trays 12,14,16 from scratches, nicks, chips, stains, finger smudges, etc. The cover 74 itself can be wiped clean, using a mild liquid cleaner and a damp cloth. The bottom of the cover 74 has preferably four feet (not shown), made of rubber or other suitable material, to protect the bottom of the cover and to stabilize it when placed on a flat surface. The color and design of the vinyl cover is such as to be aesthetically pleasing.

Obviously, many modifications and variations of the present invention are possible in light of the above teachings. It is, therefore, to be understood that within the scope of appended claims, the invention may be practiced otherwise than as specifically described.

What is claimed and desired to be secured by Letters Patent of the United States is:

1. A food carrier, comprising:

a) a plurality of stacked, interchangeable rigid food tray assemblies, at least one of said tray assemblies having a plurality of compartments formed therein;

b) strap means for securing the stacked food tray assemblies to each other, said strap means comprising a handle for carrying said food carrier, said strap means further comprising a main strap, comprising:

a first end portion;

a second, opposite, end portion comprising a terminal end including a strip of fabric of the type that has either loops or hooks that fasten to a complimentary strip of fabric having either hooks or loops, so that the strips can be fastened or unfastened by pressing them together or pulling them apart and an intermediate part having a complementary strip of said fabric; and, a loop secured to said first end portion, said main strap being sufficiently long to extend around said stacked food tray assemblies, so that said terminal end may be introduced through said loop and against said complementary strip of said fabric so as to secure said tray assemblies;

c) a thermally insulative cover for the outside of said food tray assemblies for stabilizing the temperature of any food contained therein; and d) a lid engageable upon the uppermost tray assembly, said lid having a projection for convenient handling, said main strap further comprises a cutout therein to receive said projection and thereby stabilize said main strap relative to said tray assemblies.

2. A food carrier, comprising:

a) a plurality of stacked, interchangeable rigid food tray assemblies, at least one of said tray assemblies having a plurality of compartments formed therein;

b) strap means for securing the stacked food tray assemblies to each other, said strap means comprising a handle for carrying said food carrier, said strap means further comprising a main strap, comprising:

a first end portion;

a second, opposite, end portion comprising a terminal end including a strip of fabric of the type that has either loops or hooks that fasten to a complimentary strip of fabric having either hooks or loops, so that the strips can be fastened or unfastened by pressing them together or pulling them apart and an intermediate part having a complementary strip of said fabric; and, a loop secured to said first end portion, said main strap being sufficiently long to extend around said stacked food tray assemblies, so that said terminal end may be introduced through said loop and against said complementary strip of said fabric so as to secure said tray assemblies;

c) a thermally insulative cover for the outside of said food tray assemblies for stabilizing the temperature of any food contained therein; and d) a lid engageable upon the uppermost tray assembly, said lid having a longitudinal recess formed in an upper surface thereof to receive said strap means to enhance stability of said tray assemblies.

* * * * *